US006364612B1

(12) United States Patent
Tseng

(10) Patent No.: US 6,364,612 B1
(45) Date of Patent: Apr. 2, 2002

(54) CEILING FAN STRUCTURE

(76) Inventor: Tien Fu Tseng, No. 18, Chen Hsing Tung Street, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/732,758

(22) Filed: Dec. 11, 2000

(51) Int. Cl.[7] ..... B63H 1/20; B64C 11/00
(52) U.S. Cl. ..... 416/210 R; 416/145; 416/133
(58) Field of Search ..... 416/5, 131, 133, 416/135, 144, 145, 210 R

(56) References Cited

U.S. PATENT DOCUMENTS 2,148,524 A * 2/1939 Bsrtch et al. ..... 415/140
2,484,197 A * 10/1949 Veldhuis ..... 416/133 X
2,995,295 A * 8/1961 Day ..... 416/133
3,039,678 A * 6/1962 Sharpe ..... 416/5
4,511,310 A * 4/1985 Pearce ..... 416/5 X
5,593,281 A * 1/1997 Tai ..... 416/145
5,944,487 A * 8/1999 Pearce ..... 416/5 X

* cited by examiner

*Primary Examiner*—John E. Ryznic
(74) *Attorney, Agent, or Firm*—Rosenberg, Klein & Lee

(57) ABSTRACT

A ceiling fan structure including a housing, a motor casing, a fixing disc and multiple vanes. A motor is installed in the housing and enclosed in the motor casing. The motor casing is formed with multiple thread holes on a periphery of bottom face of the motor casing. Multiple vanes are pivotally disposed on bottom side of the fixing disc via vane brackets. The fixing disc is formed with multiple through holes corresponding to the thread holes. A bolt is passed through each through hole for locking the motor casing with the fixing disc and spacing the motor casing from the fixing disc by a certain distance, A spring is fitted on each bolt within the distance for absorbing swinging force exerted onto the vanes during rotation of the ceiling fan.

1 Claim, 6 Drawing Sheets

CEILING FAN STRUCTURE

BACKGROUND OF THE INVENTION

The present invention is related to a ceiling fan structure which is able to absorb swinging force and keep the ceiling fan in a balanced state during rotation.

FIGS. 4 and 5 show a conventional ceiling fan composed of a fixing seat 81, a connecting rod 82, a housing 83, multiple vane fixing brackets 84 and multiple vanes 85. The fixing seat 81 is a semispherical body which is fixed on a ceiling via a locking bracket 811. The locking bracket 811 has two symmetrical locking sections 812 upward extending therefrom. The connecting rod 82 is connected with bottom face of the fixing seat 81. The locking bracket 811 has a lateral opening 813 through which the connecting rod 82 is passed for inlaying the fixing seat 81 in the locking bracket 811. The housing 83 is connected to the other end of the connecting rod 82. A motor 831 is installed in the housing 83 and enclosed in a motor casing 832. The periphery of bottom side of the motor casing 832 is connected with multiple vane brackets 84 by multiple bolts 86. Each vane bracket 84 is pivotally connected with a vane 85 which is radially arranged and centered at the motor 831.

In general, the vane 85 of the ceiling fan is wood-made. The wood will have slightly different specific weight due to different varieties. Therefore, the vanes 85 of the ceiling fan often have different weights. Accordingly, when assembling the ceiling fan, it is necessary to cautiously select the vanes 85 with the same weight. In the case that the respective vanes 85 mounted on the vane brackets have different weights, during rotation of the ceiling fan, the vanes 85 together with the motor 831 will swing. Under such circumstance, the motor 831 will drive the fixing seat 81 to swing on the locking bracket 811. As a result, after a period of use, the contacting sections of the fixing seat 81 and the locking bracket 811 will be speedily worn out.

Furthermore, in preliminary use, the ceiling fan can keep in a balanced state. However, after a period of use, the weight of the wooden vanes 85 may change due to humidity in the air. This leads to unbalanced state of the ceiling fan and swinging of the entire ceiling fan during rotation.

SUMMARY OF THE INVENTION

It is therefore a primary object of the present invention to provide a ceiling fan structure in which multiple springs are arranged between the motor casing and the fixing disc. The springs are able to absorb the swinging force exerted onto the vanes during rotation due to different weights of the vanes. Therefore, the ceiling fan can be safely and durably used.

The present invention can be best understood through the following description and accompanying drawings wherein:

DETAILED DESCRIPTION OF THE PREFERRED EMBODIMENT

Figure 1:
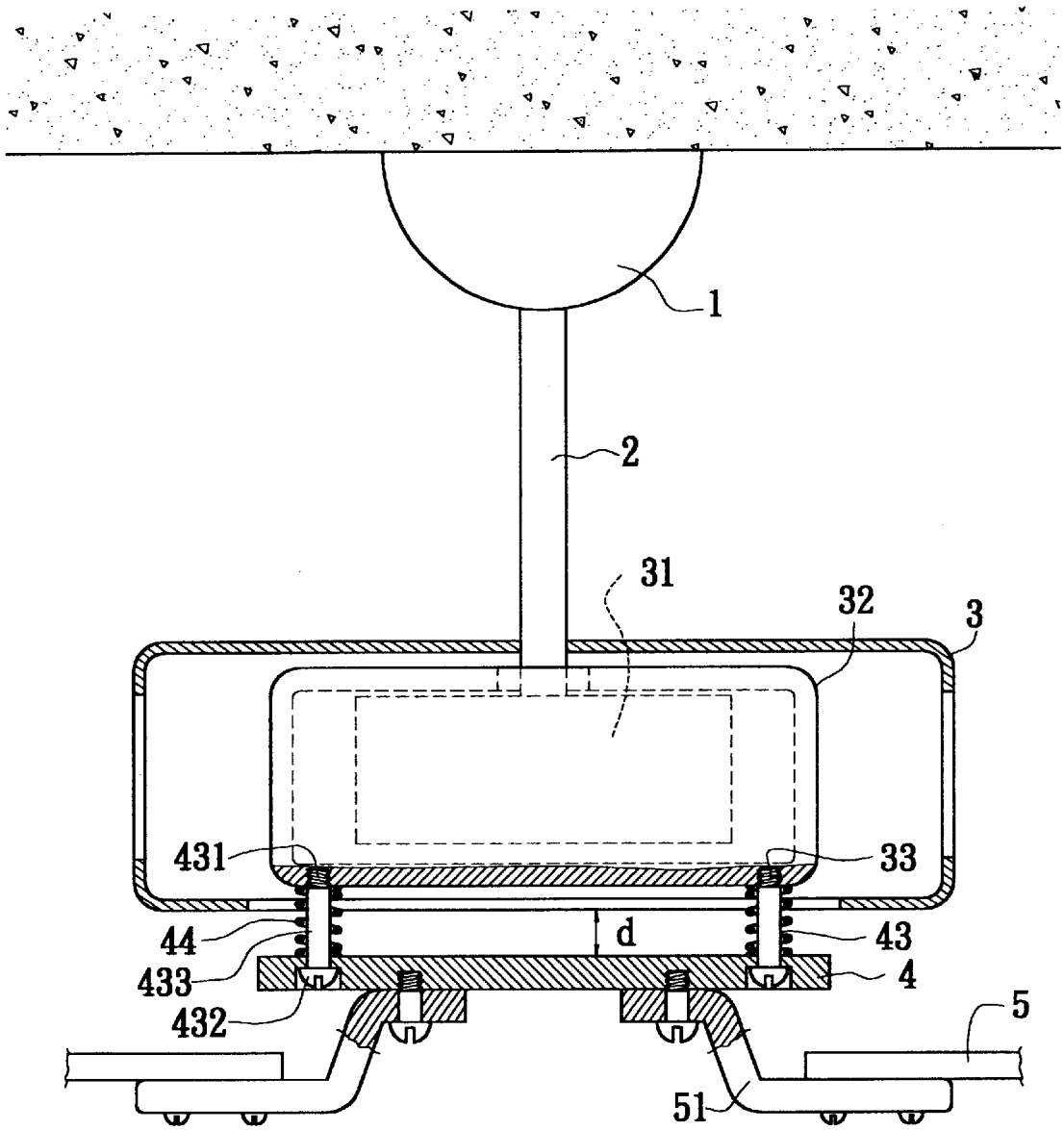
FIG. 1 is a partially sectional view the ceiling fan structure of the present invention.
Figure 2:
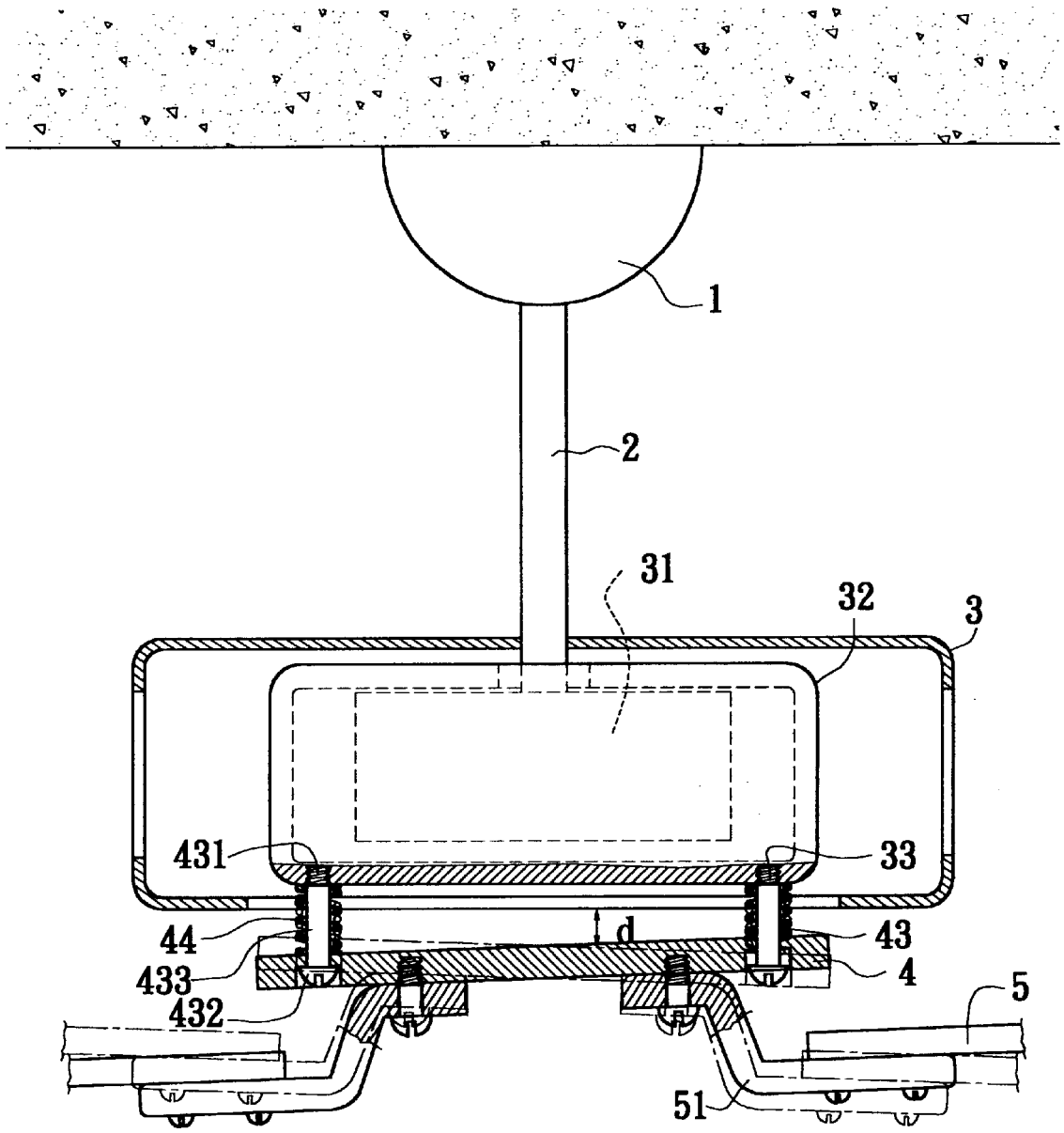
FIG. 2 is a view according to FIG. 1, showing that the springs absorb the swinging force exerted onto the vanes of the present invention.
Figure 3:
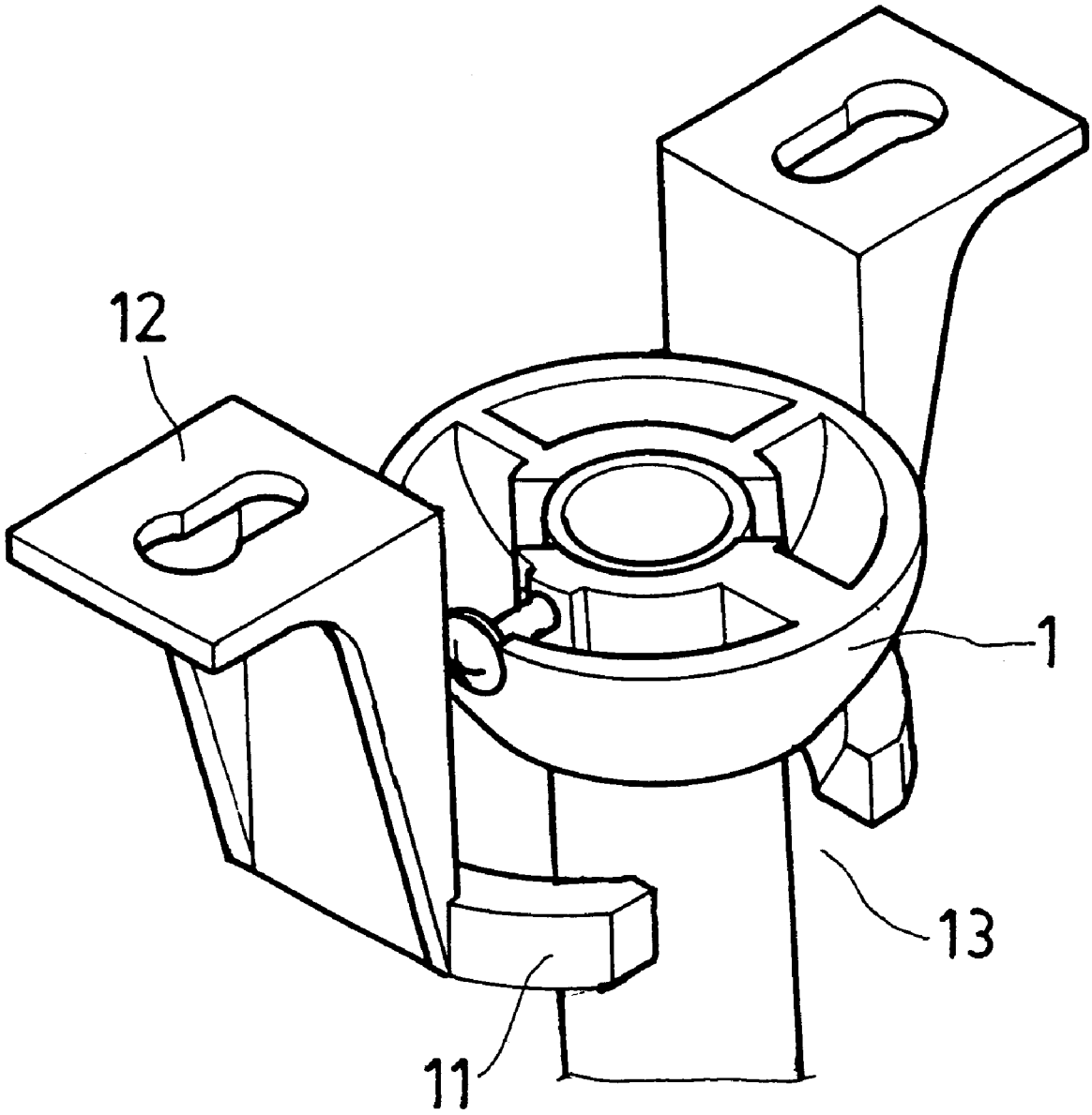
FIG. 3 is a perspective view of the fixing seat of the present invention.
Figure 4:
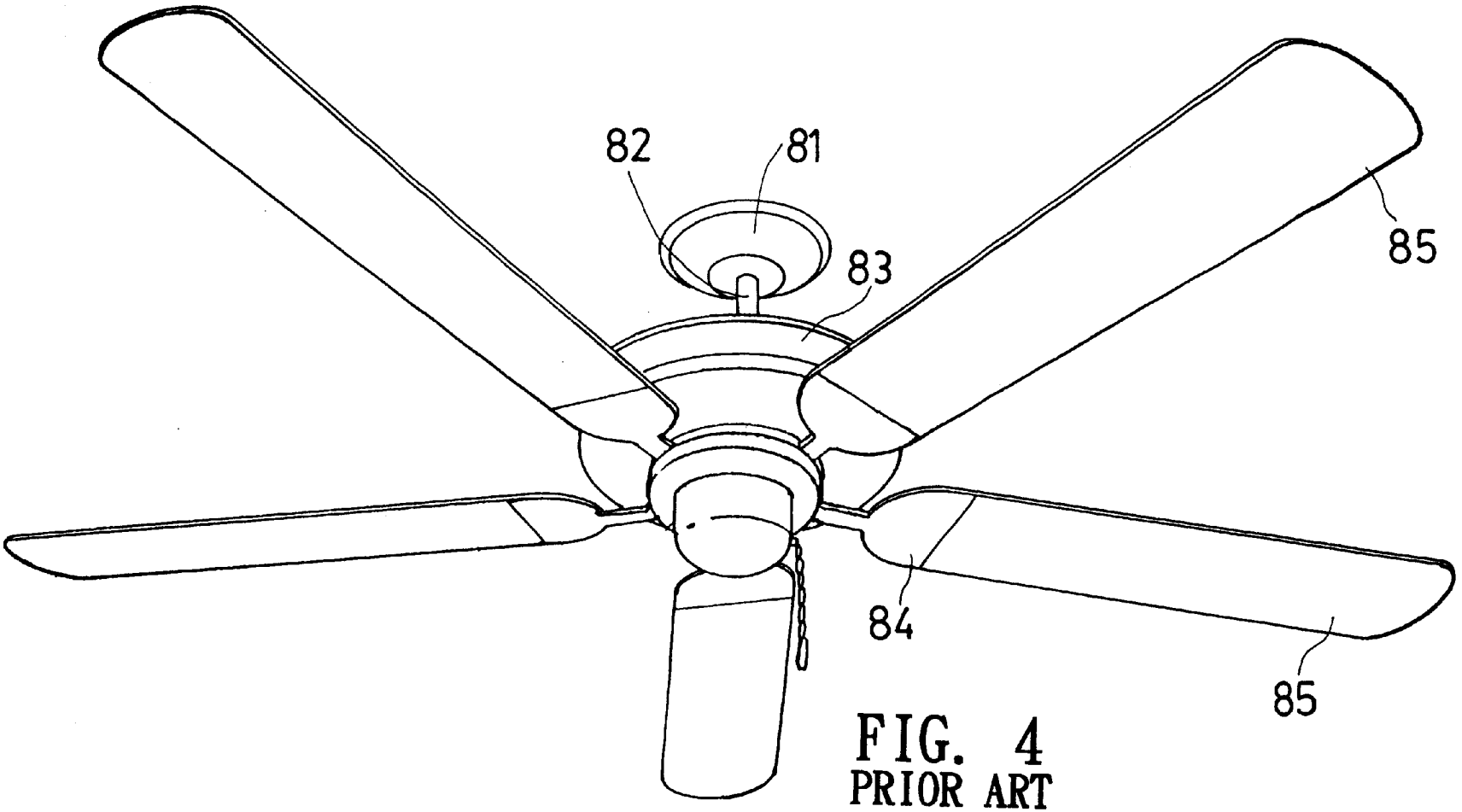
FIG. 4 PRIOR ART
FIG. 4 is a perspective view of a conventional ceiling fan.
Figure 5:
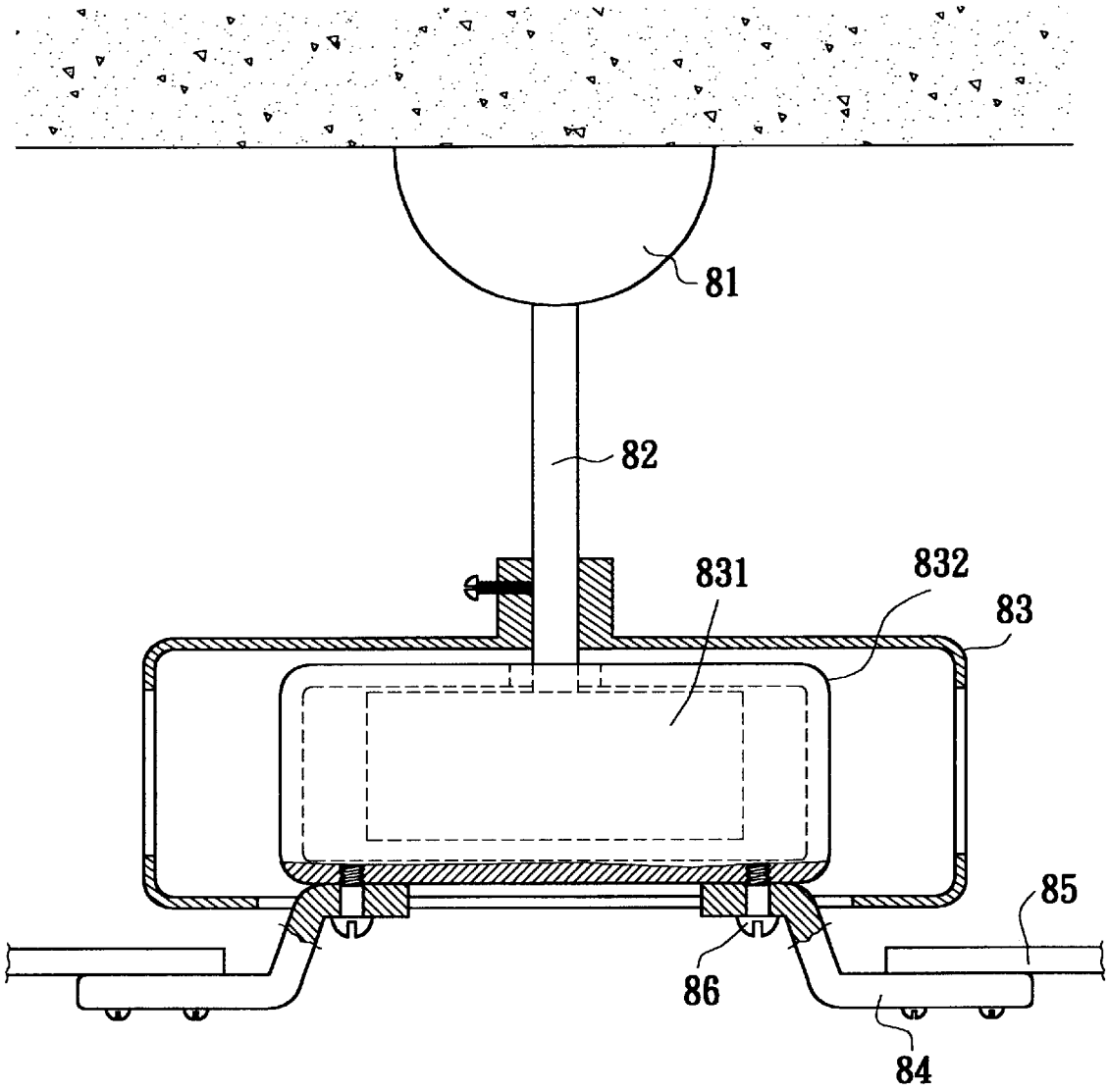
FIG. 5 PRIOR ART
FIG. 5 is a partially sectional view of the conventional ceiling fan.
Figure 6:
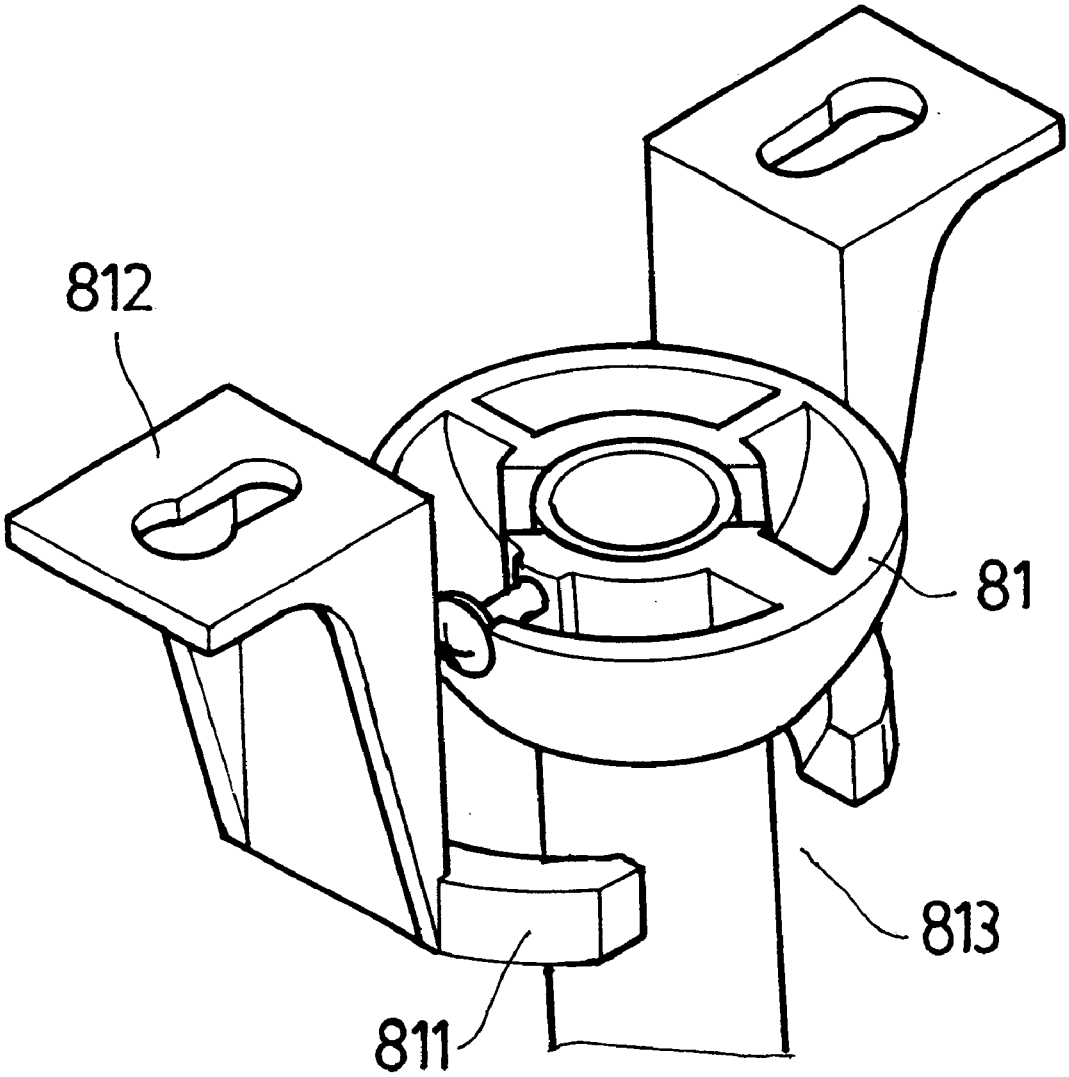
FIG. 6 PRIOR ART
FIG. 6 shows the fixing seat of the conventional ceiling fan.

Please refer to FIGS. 1 and 3. The ceiling fan of the present invention includes a fixing seat 1, a connecting rod 2, a housing 3, a fixing disc 4 and multiple vanes 5. The fixing seat 1 via a locking bracket 11 is fixed on the ceiling. The connecting rod 2 is connected with bottom face of the fixing seat 1. The locking bracket 11 has two symmetrical locking sections 12 upward extending therefrom. The locking bracket 11 has a lateral opening 13 between the two locking sections 12. The connecting rod 2 is passed through the opening 13 for inlaying the fixing seat 1 in the locking bracket 11. The housing 3 is connected to the other end of the connecting rod 2. A motor 31 is installed in the housing 3 and enclosed in a motor casing 32. The motor casing 32 is formed with multiple thread holes 33 on the periphery of bottom face of the motor casing 32. Multiple vanes 5 via vane brackets 51 are pivotally disposed on bottom side of the fixing disc 4. The bottom face of the fixing disc 4 is formed with multiple through holes 41 corresponding to the thread holes 33. A bolt 42 is passed through each through hole 41 for locking the motor casing 32 with the fixing disc 4. An upper section of the bolt 42 is a thread section 421 screwed in the thread hole 33. The lower section of the bolt 42 is a head section 422. The bolt 42 further has a polished section 423 between the head section 422 and the thread section 421. After the bolt 42 is tightened, the polished section 423 spaces the motor casing 32 from the fixing disc 4 by a certain distance d. A spring 43 is fitted on the polished section 423 within the distance d for absorbing swinging force.

In the case that the ceiling fan swings during rotation due to different weights of the vanes 5, since the motor casing 32 is spaced from the fixing disc 4 by the distance d, the fixing disc 4 has an upward displacement space. Under such circumstance, the springs 43 positioned between the motor casing 32 and the fixing disc 4 will absorb the swinging force. When the vanes 5 are laterally tilted due to swinging, the springs 43 will be partially compressed to buffer the swinging of the vanes 5. Therefore, the swinging vanes 5 will not drive the motor casing 32, the motor 31, the connecting rod 2 and the fixing seat 1 to swing along with the vanes 5. Accordingly, the fixing seat 1 will not abrade the locking bracket 12. In addition, the springs 43 serve to absorb the swinging force so that the respective vanes 43 are allowed to have slightly different weights. Therefore, it is no more necessary to so precisely select the vanes 5 with the same weights. Moreover, after a period of use, in case the weights of the vanes 5 are changed due to environmental factors and the vanes 5 start to swing during rotation, the springs 43 are able to absorb the swinging force.

In conclusion, the springs 43 positioned between the motor casing 32 and the fixing disc 4 are able to absorb the swinging force exerted onto the vanes 5 during rotation due to different weights. Therefore, the ceiling fan can be safely used without easy damage.

The above embodiment is only used to illustrate the present invention, not intended to limit the scope thereof. Many modifications of the above embodiment can be made without departing from the spirit of the present invention.

What is claimed is:

1. A ceiling fan structure comprising a housing, a motor casing, a fixing disc and multiple vanes, a motor being installed in the housing and enclosed in the motor casing, the motor casing being formed with multiple thread holes on a periphery of bottom face of the motor casing, multiple vane brackets being pivotally disposed on bottom side of the fixing disc, a vane being fixed on each of the vane brackets, the fixing disc being formed with multiple through holes corresponding to the thread holes, a bolt being passed through each through hole for locking the motor casing with the fixing disc, said ceiling fan structure being characterized in that the motor casing is spaced from the fixing disc by a certain distance and a spring is fitted on the bolt, an upper and a lower ends of the spring respectively abutting against the motor casing and the fixing disc.

* * * * *